US005816395A

United States Patent [19]

Dougherty

[11] Patent Number: 5,816,395

[45] Date of Patent: Oct. 6, 1998

[54] FOAM-LAYERED PACKAGING CASE

[75] Inventor: Thomas D. Dougherty, Richmond, Va.

[73] Assignee: TKL Products Corp., Oilville, Va.

[21] Appl. No.: 856,967

[22] Filed: May 15, 1997

Related U.S. Application Data

[63] Continuation of Ser. No. 533,315, Sep. 25, 1995, abandoned.

[51] Int. Cl.[6] ..... A45C 11/00

[52] U.S. Cl. ..... 206/314; 206/523; 150/162

[58] Field of Search ..... 206/14, 314, 523, 206/524, 6.1; 150/162; 220/400, 402, 403, 408

[56] References Cited

U.S. PATENT DOCUMENTS

| | | | |
|---|---|---|---|
| 467,724 | 1/1892 | Kleineick | 206/14 |
| 1,855,232 | 4/1932 | Gulick | 206/314 |
| 2,917,807 | 12/1959 | Scholl . | |
| 3,123,508 | 3/1964 | Waugh . | |
| 3,181,693 | 5/1965 | Freistat | 206/523 |
| 3,223,232 | 12/1965 | Coen | 206/523 |
| 3,520,769 | 7/1970 | Baker . | |
| 3,811,562 | 5/1974 | Smith | 206/523 |
| 4,303,456 | 12/1981 | Schmuck et al. . | |
| 4,433,781 | 2/1984 | Hummel | 206/523 |
| 4,575,886 | 3/1986 | Larson . | |
| 4,616,044 | 10/1986 | Fesman . | |
| 4,795,030 | 1/1989 | Boyce | 206/314 |
| 4,846,340 | 7/1989 | Walther | 206/14 |
| 4,878,972 | 11/1989 | Kaneko et al. . | |
| 4,911,962 | 3/1990 | Baumann et al. | 206/523 |
| 5,219,075 | 6/1993 | White | 206/314 |
| 5,230,940 | 7/1993 | Böhm et al. . | |
| 5,236,088 | 8/1993 | Dhority et al. | 206/523 |
| 5,354,397 | 10/1994 | Miyake et al. . | |

*Primary Examiner*—Paul T. Sewell
*Assistant Examiner*—Luan K. Bui
*Attorney, Agent, or Firm*—Lerner, David, Littenberg, Krumholz & Mentlik

[57] ABSTRACT

A method for preparing a foam-layered packaging material, which method includes the steps of providing an outer shell having a bottom wall and upwardly extending side walls defining an interior space and having an open top; pouring onto the bottom wall of the outer shell a predetermined quantity of a mixture of polyurethane foam-forming reactants; covering the open top of the outer shell with an inner protecting and cushioning layer so as to define a confined space within outer shell; and allowing the mixture of polyurethane foam-forming reactants to foam and completely fill the confined space with polyurethane foam while at the same time forming a direct bond between the foam and the inner cushioning layer over substantially the entire surface of the inner cushioning layer facing the confined space; wherein the predetermined quantity of the polyurethane foam-forming reactants is an amount effective to substantially completely fill the confined space with polyurethane foam and bond the foam with substantially the entire surface of the inner cushioning layer facing the confined space without bleeding therethrough. Foam-layered packaging cases prepared by the method of the present invention are also disclosed.

15 Claims, 2 Drawing Sheets

FOAM-LAYERED PACKAGING CASE

This is a continuation, of application Ser. No. 08/533,315 filed Sep. 25, 1995,now abandoned.

BACKGROUND OF THE INVENTION

The present invention relates to foam-layered packaging cases, and in particular to cases in which an internally blown cellular polyurethane foam layer is formed in-place in the outer shell of the case and directly bonded to an absorbent inner protecting and cushioning layer that receives the article to be packaged, without the use of a laminating adhesive. The present invention further relates to packaging cases in which the intermediate foam layer defines an inner cavity in the shape of the article to be packaged, with the protecting and cushioning layer conforming to the shape of the inner cavity.

The present invention thus relates to foam-layered packaging cases for the transportation and storage of fragile articles such as musical instruments, scientific instruments and computer hardware. The present invention also relates to methods for making the packaging cases of the present invention.

Musical instrument cases in particular typically consist of two hinged rigid outer shells having shock-absorbing foam layers defining an inner cavity in the shape of the musical instrument. The foam layer of each shell is covered with a plush or velvet fabric conforming to the shape of the inner cavity. Attempts have been made to directly bond fabric to foam while the foam layer is being cured. However, it has not been possible to accomplish this without having the foam bleed through the fabric layer. One alternative has been to mold separately the intermediate foam layer and spot-bonding the inner cushioning layer thereto. This sub-assembly is then glued into the outer shell of the case. This results in voids between the intermediate foam layer and the outer shell, as well as an unsatisfactory bond between the foam layer and inner cushioning layer.

Bleed-through has also been prevented by laminating or impregnating a barrier layer onto the fabric. It has still been necessary to mold separately the foam layer while laminating the inner cushioning layer thereto. The barrier layer detracts from the shock-absorbing properties of the foam layer. The bond formed between the barrier layer and the foam layer, as well as between the barrier layer and the inner cushioning layer has also been unsatisfactory.

There remains a need for a method by which the fabric linings of musical instrument cases may be directly laminated to a shock-absorbing foam inner layer. Not only would the shock-absorbing qualities of the assembly be improved, a significant production cost advantage would be realized by directly laminating fabric to foam.

SUMMARY OF THE INVENTION

This need is met by the present invention. It has now been discovered that an integral bond may be created between the inner cushioning layer, fabric layer and outer shell of packaging cases, without bleed-through of the foam through the inner cushioning layer. The present invention employs a predetermined quantity of a mixture of polyurethane foam-forming reactants, selected so that an excessive quantity of foam is not produced that would otherwise be forced through the fabric. Foaming in-place also allows for the shell of the packaging case to be completely filled with foam, thereby improving the shock-absorbing properties of the case. Packaging cases prepared in accordance with the present invention have a rigid outer shell that does not bow or otherwise yield and an absorbent inner cushioning layer tightly adhered to the foamed in-place foam layer without bleed-through of the foam through the inner cushioning layer.

Therefore, according to one embodiment of the present invention, a method is provided for preparing a foam-layered packaging material, which method includes the steps of:

- providing an outer shell having a bottom wall and upwardly extending side walls defining an interior space and having an open top;
- pouring onto the bottom wall of the outer shell a predetermined quantity of a mixture of polyurethane foam-forming reactants;
- covering the open top of the outer shell with an inner protecting and cushioning layer so as to define a confined space within the outer shell; and
- allowing the mixture of polyurethane foam-forming reactants to foam and completely fill the confined space with polyurethane foam while at the same time forming a direct bond between the foam and the inner cushioning layer over substantially the entire surface of the inner cushioning layer facing the confined space;
- wherein the predetermined quantity of polyurethane foam-forming reactants is an amount effective to substantially completely fill the confined space with polyurethane foam and bond the foam with substantially the entire surface of the inner cushioning layer facing the confined space without bleeding therethrough.

In accordance with one aspect of this embodiment of the present invention, an inner cavity is formed in the polyurethane foam in the shape of the article to be packaged, with the inner cushioning layer conforming to the shape of the inner cavity. Methods in accordance with this aspect of the present invention position the inner cushioning layer over the top side of the outer shell with a molding means having a plug for forming an article-shaped inner cavity in the polyurethane foam, so that the polyurethane foam is formed with an inner cavity defined therein, with the inner cushioning layer directly bonded thereto and conforming to the shape of the inner cavity.

Another aspect of this embodiment of the present invention distributes the polyurethane foam-forming reactants to provide a foam layer of varying thickness. Methods in accordance with this aspect of the present invention distribute the predetermined quantity of the polyurethane foam-forming reactants on the bottom wall of the outer shell so that a foam layer of varying thickness is formed.

Another embodiment of the present invention includes foam-layered packaging cases having intermediate foam layers that have been foamed in-place with an inner cushioning layer directly bonded thereto. Foam-layered packaging cases in accordance with this embodiment of the present invention have an inner protecting and cushioning layer having a first surface opposite a second surface for receiving an article to be packaged; an intermediate foam layer of an internally-blown cellular polyurethane foam having a first surface opposite a second surface directly bonded to substantially the entire first surface of the inner layer without penetrating therethrough; and an outer shell in direct contact with and surrounding the first surface of the intermediate layer.

According to one aspect of this embodiment of the present invention, the intermediate foam layer of the packaging case defines an inner cavity in the shape of the article to be packaged, whereby the inner protecting and cushioning layer conforms to the shape of the inner cavity. In accordance with another aspect of this embodiment of the present invention, instrument cases are provided, whereby the outer shell has opposing first and second half-shells hinged together connected to form a packaging case. In this aspect of the present invention, the inner cavity of the case is preferably dimensioned to receive securely a stringed musical instrument therein.

The packaging cases of the present invention represent a significant improvement over prior art packaging cases employing barrier layers or spot-bonding the inner cushioning layer, in terms of both laminate strength and shock-absorbing properties, without sacrificing product appearance because of bleed-through of the foam through the inner cushioning layer. The packaging cases of the present invention are particularly well suited for the transportation and storage of musical instruments, particularly stringed musical instruments such as guitars, violins, and the like, scientific instruments, cameras, video recorders, jewelry, computer hardware, including laptop computers, and the like. Other features of the present invention will be pointed out in the following description and claims, which disclose the principles of the invention and the best modes which are presently contemplated for carrying them out.

BRIEF DESCRIPTION OF THE DRAWINGS

A more complete appreciation of the invention and many more other intended advantages can be readily obtained by reference to the detailed description of the invention when considered in connection with the following drawings, wherein.

Figure 1:
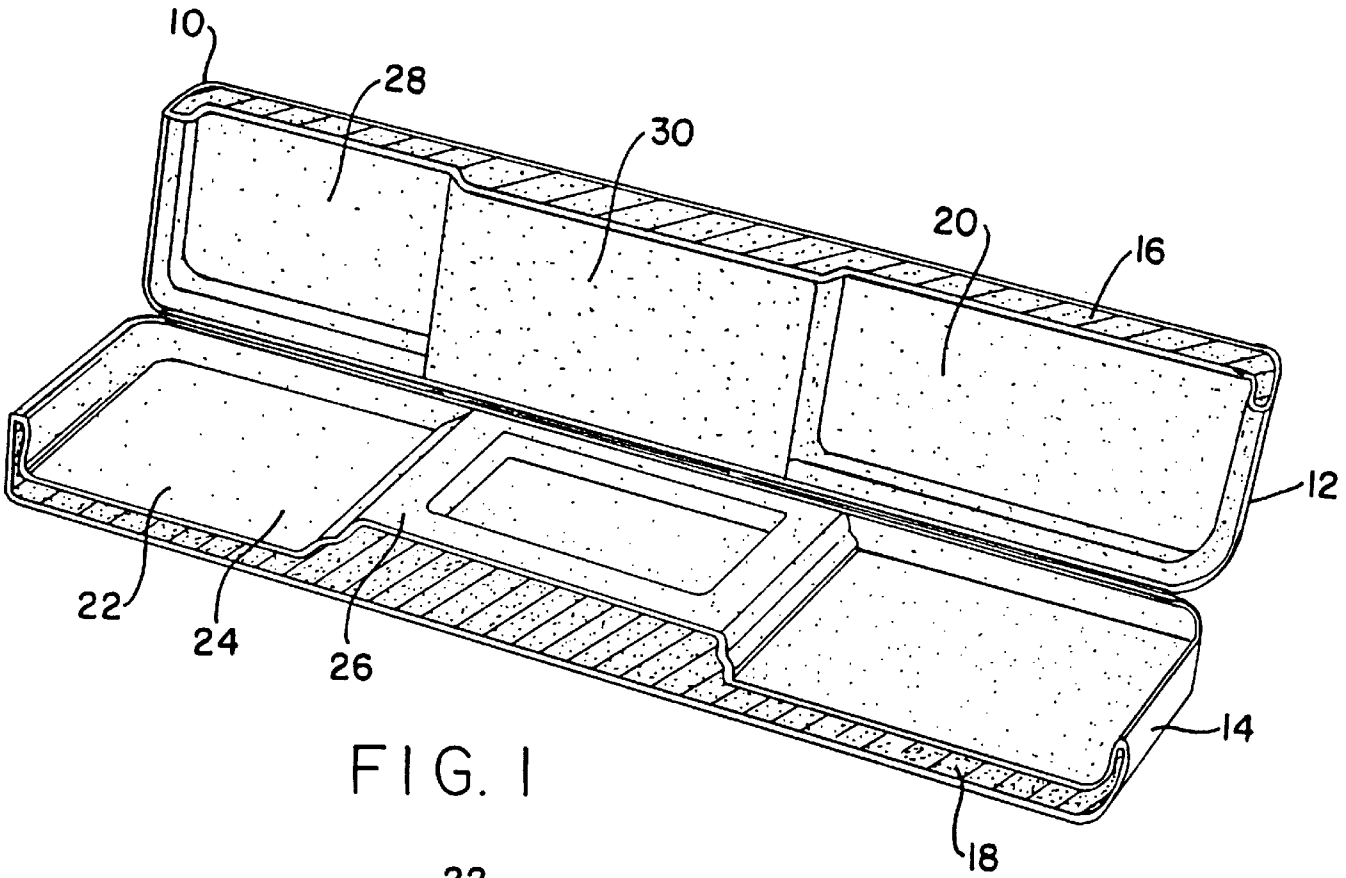
FIG. 1 shows a side, cross-sectional view of a device according to the present invention.
Figure 1A:
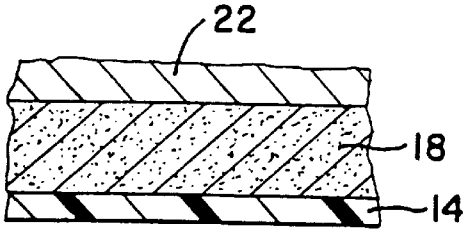

It should be noted that the drawings are not necessarily to scale, but that certain elements have been expanded to show more clearly the various aspects of the present invention and their advantages.

DETAILED DESCRIPTION OF THE PREFERRED EMBODIMENT

The foam-layered packaging cases of the present invention are prepared by the in-place foaming of an intermediate foam layer in an outer shell defining the exterior shape of the case. An inner protecting and cushioning layer of fabric or prefabricated foam is contacted with the intermediate foam layer as the foam is formed, so that a direct bond is formed between the foam and the inner cushioning layer, without the use of a laminating adhesive.

The direct bond that forms between the inner cushioning layer and the intermediate foam layer as the foam layer is formed may be a mechanical bond or a chemical bond and is preferably a combination of the two bonds. The mechanical bond forms by partial penetration of the foam layer into the inner cushioning layer without bleeding therethrough. Chemical bonds may be formed between the foam layer and the inner cushioning layer when the inner cushioning layer contains a synthetic material capable of reacting with the components of the foam. Thus, a chemical bond will be formed when the inner cushioning layer is a woven or non-woven fabric containing a synthetic component such as vinyl, polyester, nylon, and the like. The inner cushioning layer is preferably an absorbent, natural or synthetic, woven or non-woven, fabric. The fabric is preferably plush or velvet on the surface for receiving the article to be packaged.

The inner protecting and cushioning layer may also be an absorbent prefabricated foam that is directly laminated to the intermediate polyurethane foam. The surface of the inner cushioning layer opposite the intermediate foam layer may then have a fabric layer adhesively laminated thereto.

When the inner cushioning layer is a prefabricated foam layer, the foam must be capable of forming either mechanical or a chemical bond with the intermediate polyurethane foam layer as the polyurethane foam layer is foamed in-place. Such foams typically include polyolefinic foams, a second polyurethane foam, such as an elastomeric urethane foam, and the like. A partial layer of prefabricated foam may also be used to form the inner cavity for receiving the article to be packaged.

As noted above, a fabric layer, such as a velvet or plush fabric, may be adhesively laminated to an inner foam cushioning layer. The means by which this is accomplished is essentially conventional and well understood by those of ordinary skill in the art. It is preferred, however, that a cloth or fabric inner cushioning layer such as plush or velvet fabric be directly laminated to the intermediate polyurethane foam layer as the foam layer is being foamed in-place.

As is well understood by those of ordinary skill in the art, polyurethane foams are generally prepared by the reaction of a polyester or polyether polyol with an organic polyisocyanate in the presence of a blowing agent and optionally in the presence of additional polyol-containing components, chain-extending agents, catalysts, surface-active agents, stabilizers, dyes, fillers and pigments. Such foams are known as internally-blown or water-blown foams. Suitable processes for the preparation of cellular polyurethane foams are disclosed in Reissue U.S. Pat. No. 24,514, together with suitable machinery to be used in conjunction therewith, the disclosure of which is herein incorporated by reference. When water is added as the blowing agent, corresponding quantities of excess isocyanate to react with the water and produce carbon dioxide may be used.

It is possible to proceed with the preparation of the polyurethane foam by prepolymer techniques wherein an excess of organic polyisocyanate is reacted in a first step with the polyol to prepare a prepolymer having free isocyanate groups, which is then reacted in a second step with water and/or additional polyol to prepare a foam. Alternatively, the components may be reacted in a single working step commonly known as a "one-shot" technique of preparing polyurethanes. Furthermore, instead of water, low-boiling hydrocarbons such as pentane, hexane, heptane, pentene and heptene; azo compounds such as azohexahydrobenzodinitrile; halogenated hydrocarbons such as dichlordifluoromethane, trichlorofluoromethane, dichlorodifluroethane, vinylidene chloride and methylene chloride may be used as blowing agents.

Any suitable hydroxyl-terminated polyester may be used, such as are prepared, for example, from polycarboxylic acids and polyhydric alcohols. Any suitable polycarboxylic acid may be used such as oxalic acid, malonic acid, succinic acid, glutaric acid, adipic acid, pimelic acid, suberic acid, azelaic acid, sebacic acid, brassylic acid, thapsic acid, maleic acid, fumaric acid, glutaconic acid, alpha-hydromuconic acid, beta-hydromuconic acid, alpha-butyl-alpha-ethyl glutaric acid, alpha,beta-diethylsuccinic acid, isophthalic acid, terephthalic acid, hemimellic acid, and 1,4-cyclohexane-dicarboxylic acid. Any suitable polyhydric alcohol, including both aliphatic and aromatic, may be used such as ethylene glycol, propylene glycol, trimethylene glycol, 1,2-butanediol, 1,3-butanediol, 1,4-butanediol, 1,2-pentanediol, 1,4-pentanediol, 1,5-pentanediol, 1,6-hexanediol, 1,7-heptanediol, glycerol, 1,1,1-trimethylolpropane, 1,1,1-trimethylolethane, 1,2,6-hexanetriol, alpha-methyl glucoside, pentaerythritol and sorbitol. Also included with the term "polyhydric alcohol" are compounds derived from phenols such as Bisphenol A.

The hydroxyl-containing polyester may also be a polyester amide such as is obtained by including some amine or amino alcohol and the reactants for the preparation of the polyesters. Thus, polyester amides may be obtained by condensing an amino alcohol such as ethanolamine with the polycarboxylic acids set forth above or the may be made using the same components that.

Any suitable polyether polyol may be used such as the polymerization product of an alkylene oxide or a mixture of alkylene oxides with a polyhydric compound. The preferred alkylene oxides include ethylene oxide, propylene oxide, butylene oxide, amylene oxide, and mixtures of these oxides. The polyether polyols are also preferably prepared from other starting materials such as tetrahydrofuran and alkylene oxide-tetrahydrofuran mixtures; epihalohydrins such as epichlorohydrin; as well as arylalkylene oxides such as styrene oxide. The polyether polyols may have either primary or secondary hydroxyl groups. Included among the more preferred polyether polyols are polyoxyethylene glycol, polyoxypropylene glycol, polyoxybutylene glycol, and polytetramethylene glycol: block copolymers, for example, combinations of polyoxypropylene and polyoxyethylene glycols, poly(1,2-oxybutylene) and polyoxyethylene gly-cols, Poly(1,4-oxybutylene and polyoxyethylene glycols, and random copolymer glycols prepared from blends of two or more alkylene oxides or from the sequential addition of two or more alkylene oxides.

Organic diisocyanates, and polyisocyanates thereof, which may be employed include aromatic, aliphatic and cycloaliphatic polyisocyanates and combinations thereof. Representative of preferred types of these diisocyanates are m-phenylene diisocyanate, 4,4'-diphenylmethane diisocyanate, 2,4-toluene diisocyanate, 2,6-toluene diisocyanate, mixtures of 2,4- and 2,6-toluene diisocyanate, hexamethylene diisocyanate, tetramethylene diisocyanate, cyclohexane-1,4-diisocyanate, hexahydrotoluene diisocyanate (and isomers), naphthalene-1,5-diisocyanate, 1-methoxyphenyl-2,4-diisocyanate, 4,4'-biphenylene diisocyanate, 3,3'-dimethoxy-4,4'-biphenyl diisocyanate, 3,3'-dimethyl-4,4'-diisocyanate and 3,3'-dimethyldiphenylmethane-4,4'-diisocyanate; triisocyanates such as 4,4'4"-triphenylmethane triisocyanate and toluene 2,4,6-triisocyanate; tetraisocyanates such as 4,4'dimethyldiphenylmethane-2,2',5,5'-tetraisocyanate; and polymeric polyisocyanates such as polymethylene polyphenylene polyisocyanate and polymeric diphenylmethane diisocyanate. Especially preferred because of their availability and properties are toluene diisocyanate, 4,4'-diphenylmethane diisocyanate and polymethylene polyphenylene polyisocyanate.

Crude polyisocyanates may also be used, such as crude toluene diisocyanate obtained by the phosgenation of a mixture of toluene diamines or crude diphenylmethane diisocyanate obtained by the phosgenation of crude diphenylmethane diamine. Preferred crude polyisocyanates are disclosed in U.S. Pat. No. 3,215,652.

A particularly preferred diisocyanate is the blend of 50% 4,4'-diphenylmethane diisocyanate and 50% polymeric 4,4'-diphenylmethane diisocyanate manufactured by IPI of Elkton, Md. and sold under the brand designation ISO-FOAM® R-1267A. The polyol for use in combination with this material is sold under the brand designation ISO-FOAM® R-1267B, a proprietary blend of polyols. Another particularly preferred diisocyanate is the mixture of 4,4'-diphenylmethane diisocyanate and oligomers thereof manufactured by the Carpenter Co. of Richmond, Va. and sold under the brand designation RICHFLEX® 202-2407. The polyol for use in combination with this material is sold under the brand designation RICHFLEX® 202–2389, another proprietary blend of polyols.

Chain extending agents which may be employed in the preparation of polyurethane foams include those compounds having at least two functional groups bearing active hydrogen atoms such as water, hydrazine, primary and secondary amines, amino alcohols, amino acids, hydroxyl acids, glycols, or mixtures thereof. A preferred group of chain extending agents includes water, ethylene glycol, 1,4-butanediol and primary and secondary diamines that react more readily with the polymerizing polyurethane than does water, such as phenylenediamine, 1,4-cyclohexane-bis-(methylamine), ethylenediamine, diethylenetriamine, N-(2-hydroxyl-propyl) ethylenediamine, N,N'-di(2-hydroxylpropyl) ethylenediamine, piper-azine and 2-methylpiperazine.

Any suitable catalyst may be used, including tertiary amines such as, for example, triethylene diamine, N-methylmorpholine, N-ethylmor-pholine, diethylethanolamine, N-cocomorpholine, 1-methyl-4-dimethyl-aminoethyl piperazine, 3-methoxypropyldimethylamine, N,N,N'-trimethyl-isopropylpropylenediamine, 3-diethylaminopropyldiethylamine, dimethyl-benzylamine, and the like. Other suitable catalysts are, for example, stannous chloride, dibutyltin-di-2-ethylhexanoate, stannous oxide, as well as other organometallic compounds such as are disclosed in U.S.Pat. No. 2,846,408.

A surface active agent is generally necessary for production of high grade polyurethane foam according to the present invention, to prevent foam collapse or the formation of very large uneven cells. Numerous surface-active agents have been found satisfactory. Nonionic surface active agents are preferred. Of these, the nonionic surface-active agents such as the well-known silicones have been found particularly desirable. Other surface-active agents which are operative, although not preferred, include polyethylene glycol ethers of long-chain alcohols, tertiary amine or alkanolamine salts of long-chain alkyl acid sulfate esters, alkyl sulfonic esters and alkyl arylsulfonic acids.

The intermediate foam layer of the present invention is preferably a cellular polyurethane foam. The foam may be rigid, semirigid or flexible. As noted above, the packaging case outer shell may have first and second half-shells hinged together to form the packaging case. The two half-shells may include a bottom half for receiving the item to be packaged and a top half functioning as a lid.

Semi-rigid foams should have a free-rise density between about 2.2 and about 2.8 lbs./ft$^3$. For rigid foams the free rise density should be between about 1.4 and about 1.8 lbs./ft$^3$. Flexible foams have free-rise densities greater than 2.8 lbs./ft.$^3$, up to 5.0 lbs./ft.$^3$, and greater. It is not essential that the foam be free-rising. Non-free-rising foams should be selected to provide the final densities set forth below for rigid, semi-rigid and flexible foams.

A wide variety of materials are suitable for use as the outer shell. Essentially any material suitable for use as a packaging case exterior may be used, provided that it is non-porous, so that foam bleed-through does not occur. Examples of suitable materials include cardboard, wood, synthetic materials such as plastics, metals such as aluminum, and the like. Preferred plastics include polystyrene, polyethylene, polyurethane and polyurea.

The bond that forms between the outer shell and the intermediate foam layer also may be a mechanical bond or a chemical bond, and is also preferably a combination of the two bonds. The mechanical bond is formed by expansion and swelling of the intermediate foam layer against the outer layer with such force that the foam layer is securely locked in place. Chemical bonds may be formed between the foam layer and the outer shell when the outer shell is a polymeric plastic material capable of reacting with components of the foam. Thus, a chemical bond will be formed when the outer shell is a polymeric plastic such as the above-listed preferred examples. For guitar cases, the outer shell is preferably polystyrene coextruded with a virgin polystyrene cap sheet.

The intermediate foam layer is foamed in-place on the outer shell by metering together a first stream containing an isocyanate polymer or prepolymer and a second stream containing the catalyst, polyol, surfactant stabilizer and optionally, water. More particularly, the two streams are metered together in a mixing/dispensing unit that oscillates back and forth across the interior of the outer shell, laying down a coating of the foam formula. Preferably, the mixing/dispensing unit distributes the foam formula across the interior of the outer shell, varying the amount dispensed according to variations in the thickness of the intermediate foam layer to be formed.

The dispensing and distribution of the polyurethane foam-forming reactants is typically performed using a microprocessor controlled mixing/dispensing unit such as a Hi/Tech Sure Shot 100, manufactured by the Hi/Tech Equipment Co. of Grand Rapids, Mich., a complete two-component, cylinder metering, microprocessor-controlled reaction injection molding machine . The overall foam thickness and variations therein can be readily determined by one of ordinary skill in the art without undue experimentation, and is a function of several parameters that determine the extent to which the foam will rise (expansion rate), the rate at which it will rise, and the density of the foam. The parameters include the selection of the foam-forming reactants, the ratio of diisocyanate to polyol, the amount dispensed, the temperature and pressure at which the foam-forming reactants are dispensed, and the temperature to which the outer shell is pre-heated.

Microprocessor-controlled mixing/dispensing units can be programmed to control the ratio of the foam-forming reactants, the amount dispensed, and the temperature and pressure at which the materials are dispensed. The temperature of the outer shell may be separately controlled. The parameters are until a foam having a desired thickness profile, rate of expansion and density is obtained.

The rate at which the foam rises is selected to allow sufficient time to mate the intermediate foam layer with the inner cushioning layer. This is typically between about 5 and about 30 seconds, and preferably between about 15 and about 20 seconds. Consideration must be given to the porosity of the inner cushioning layer when selecting foam thickness and rate of expansion.

The most critical parameter is the choice of the foam-forming reactants. A diisocyanate and polyol must be selected having foaming properties and density capable of being fine-tuned to provide the desired thickness profile, rate of expansion and density. The preferred diisocyanate and polyol combinations suitable for use with the present invention have been disclosed above. The diisocyanate and polyol should be dispensed at a ratio between about 3:5 and about 1.5:1 for rigid polyurethane foams. A 1:1 ratio is preferred. For semi-rigid polyurethane foams, the diisocyanate and polyol should be dispensed at a ratio between about 1:1 and about 1:1.5. A 1:1 ratio is also preferred.

For manufacturing guitar cases in accordance with the present invention, the dispensing temperature is between about 65 and about 80° F., and preferably between about 65 and about 70° F. The dispensing pressure is between about 1500 and about 2500 psi, and preferably between about 1800 and about 2000 psi. The outer shell is heated to a temperature between about 90 and about 120° F., and preferably between about 95 and about 105° F.

Under the foregoing conditions, the fully-cured foam will have a final density greater that the free rise density rating for the foam-forming reactants. Rigid polyurethane foams will have a final density between about 2.0 and about 3.0 lbs./ft$^3$. Semi-rigid polyurethane foams will have a final density between about 3.0 and about 4.8 lbs./ft$^3$. There some density overlap between semi-rigid and flexible polyurethane foams. Flexible polyurethane foams will have a final density greater than about 4.25 lbs./ft.$^3$, typically up to about 10.0 lbs./ft.$^3$ As noted above, the foregoing final density values apply equally as well to non-free-rising foams.

The inner protecting and cushioning layer is then brought into contact with the rising foam in the outer shell as the intermediate foam layer is formed. Typically, the inner cushioning layer is cut from a template and placed on a support that holds the cushioning layer in place until the bond between the cushioning layer and the intermediate foam layer is formed, typically about three to six minutes, and preferably about five minutes.

To form an inner cavity in the shape of the article to be packaged, the support for the inner cushioning layer has a mold with a plug in the form of the desired shape. The mold is covered with the inner cushioning layer material and brought into contact with the rising foam in the outer shell. A pre-metered amount of foam-forming reactants is dispersed into the case shell and clamped closed, typically for about three to six minutes. The intermediate foam layer then forms around the mold or plug, with an impression in the shape of the article to be packaged. The inner cushioning layer, by being between the mold or plug and the rising foam, conforms to the shape of the impression. The mold is then opened.

As noted above, a lower quantity of the foam-forming reactants should be distributed in the portion of the outer shell opposite the mold or plug. This will prevent bleed-through of the foam into the articleshaped inner cavity. When, as with musical instrument cases, the packaging case is formed as two half-shells, each half is preferably formed with an article-shaped inner cavity, so that when the two halves are mated, a three-dimensional void is formed, conforming to the three-dimensional shape of the article to be packaged.

Essentially conventional finishing steps are then performed to obtain the final product. The inner cushioning layer material is cut and tucked alongside the case valance. Latching mechanisms, when employed, are also attached. A protective or decorative finish may then be applied to the exterior of the outer shell, if desired.

Figure 2:
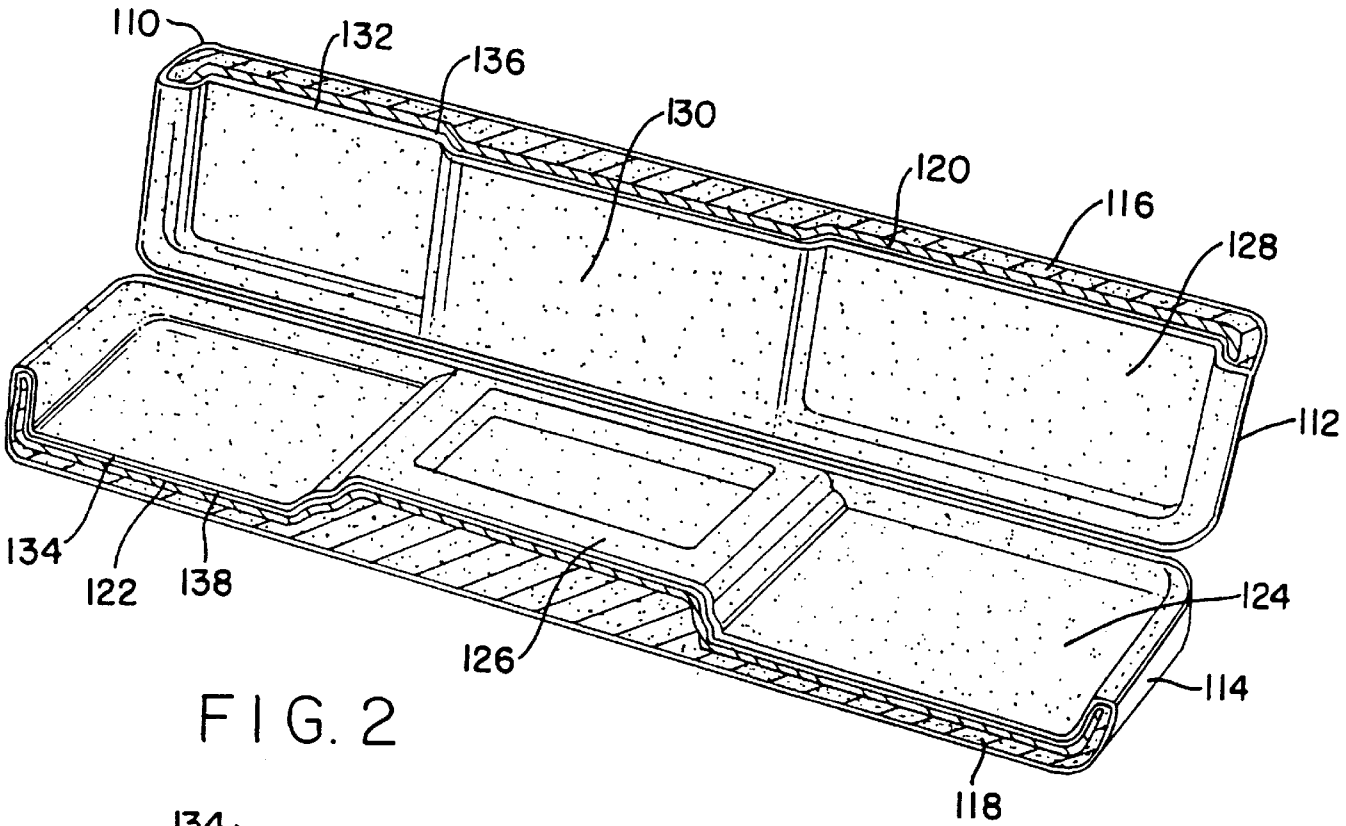
FIG. 2 shows a side, cross-sectional view of a related embodiment of the present invention.
Figure 2A:
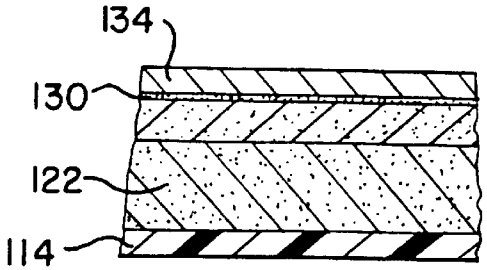

Referring to FIGS. 1 and 2, guitar cases are depicted in accordance with the present invention. In FIG. 1, guitar case 10 consists of lid half-shell 12 and bottom half-shell 14, which are hinged together (not shown). Intermediate foam layers 16 and 18 have been formed in each half-shell, to which inner cushioning layers 20 and 22 have been directly bonded. The bottom half-shell 14 contains inner cavity 24 with raised portion 26, while the lid half-shell 12 contains inner cavity 28 with raised portion 30. The raised portions 26 and 30 are formed with additional quantities of foam-forming forming reactants. In the alternative, all or part of the raised portions may be formed with pieces of prefabricated foam.

In FIG. 2, guitar case 110 consists of a lid half-shell 112 and bottom half shell 114, which are hinged together (not shown). Intermediate foam layers 116 and 118 have been formed in each half-shell, to which inner cushioning layers 120 and 122 have been directly bonded. The inner cushioning layers 120 and 122 consist of prefabricated polyethylene foam to which fabric laminates 132 and 134 have been bonded with adhesive layers 136 and 138, respectively. The bottom half-shell 114 contains inner cavity 124 with raised portion 126, while the lid half-shell 112 contains inner cavity 128 with raised portion 130. The raised portions 126 and 130 are formed with additional quantities of foam-forming reactants, around which inner cushioning layers 120 and 122 and fabric laminates 132 and 134 have been respectively molded. Alternatively, the foam inner cushioning layer may be limited to the raised portions, with the fabric laminates otherwise directly bonded to the intermediate foam layers as a second inner cushioning layer.

As will be readily appreciated, numerous variations and combinations of the features set forth above can be utilized without departing from the present invention as set forth in the claims. Such variations are not regarded as a departure from the spirit and scope of the invention, and all such variations are intended to be included within the scope of the following claims.

What is claimed is:

1. A foam-layered packaging case comprising:

an inner cushioning and protecting fabric layer having a first surface opposite a second surface for receiving an article to be packaged;

an intermediate foam layer of an internally blown cellular polyurethane foam having a first surface opposite a second surface directly bonded to substantially the entire first surface of said inner cushioning fabric layer without a barrier layer between said first surface of said fabric layer and said second surface of said foam layer and without said foam penetrating through said fabric layer; and an outer shell in direct contact with and surrounding said first surface of said intermediate layer.

2. The foam-layered packaging case of claim 1, wherein said outer shell comprises opposing first and second half-shells hinged together to form a packaging case;

wherein each of said first and second half-shells comprise respective first and second inner cushioning and protecting fabric layers, each layer having a first surface opposite a second surface for receiving an article to be packaged; and respective first and second intermediate foam layers of an internally-blown cellular polyurethane foam having first surfaces opposite second surfaces directly bonded to substantially the entire first surfaces of said respective first and second inner cushioning fabric layers without penetrating therethrough;

wherein said first and second half-shells are in direct contact with and surround said first surfaces of said respective first and second intermediate layers.

3. The foam-layered packaging case of claim 2, wherein said second surfaces of said respective first and second intermediate foam layers contacting said respective first and second half-shells define an inner cavity with said respective first and second inner cushioning fabric layers bonded to said respective first and second intermediate foam layers defining said inner cavity.

4. The foam-layered packaging case of claim 3, wherein said inner cavity is dimensioned to receive securely a stringed musical instrument therein.

5. The foam-layered packages material of claim 3, wherein said inner cavity is defined at least in part by foam layers adhesively laminated to said first surfaces of said respective first and second inner cushioning fabric layers and directly bonded to said second surfaces of said respective first and second intermediate foam layers.

6. The foam-layered packaging case of claim 1, wherein said intermediate foam layer comprises rigid polyurethane foam having a final density between about 2.0 and about 3.0 lbs./ft.$^3$.

7. The foam-layered packaging case of claim 1, wherein said intermediate foam layer comprises semi-rigid polyurethane foam having a final density between about 3.0 and about 4.8 lbs./ft.$^3$.

8. The foam-layered packaging case of claim 1, wherein said intermediate foam layer comprises flexible polyurethane foam having a final density greater than 4.25 lbs./ft.$^3$.

9. The foam-layered packaging case of claim 1, wherein a portion of said inner cushioning fabric layer is adhesively laminated to a prefabricated foam layer directly bonded to said intermediate foam layer.

10. The foam-layered packaging case of claim 1, wherein said intermediate foam layer is mechanically bonded to said inner cushioning fabric layer.

11. The foam-layered packing case of claim 1, wherein said intermediate foam layer is chemically bonded to said inner cushioning fabric layer.

12. The foam-layered packaging case of claim 11, wherein said intermediate foam layer is both mechanically bonded and chemically bonded to said inner cushioning fabric layer.

13. The foam-layered packaging case of claim 1, wherein said intermediate foam layer is mechanically bonded to said outer shell.

14. The foam-layered packaging case of claim 1, wherein said intermediate foam layer is chemically bonded to said outer shell.

15. The foam-layered packaging case of claim 14, wherein said intermediate foam layer is both mechanically bonded and chemically bonded to said outer shell.

* * * * *

UNITED STATES PATENT AND TRADEMARK OFFICE

CERTIFICATE OF CORRECTION

PATENT NO. : 5,816,395
DATED : October 6, 1998
INVENTOR(S) : Dougherty

It is certified that error appears in the above-identified patent and that said Letters Patent is hereby corrected as shown below:

Column 5, lines 12, 13, delete "or the may be made using the same components that".

Column 7, line 54, "are until" should read --are controlled until--.

Column 8, line 21, "There some" should read --There is some--.

Column 8, line 52, "articleshaped" should read --article-shaped--.

Column 9, line 8, delete "forming" (second occurrence).

Column 10, line 19, "packages material" should read --packaging case--.

Signed and Sealed this

Sixteenth Day of March, 1999

*Attest:*

Q. TODD DICKINSON

*Attesting Officer*

*Acting Commissioner of Patents and Trademarks*